US006560347B2

(12) United States Patent
Chung

(10) Patent No.: US 6,560,347 B2
(45) Date of Patent: May 6, 2003

(54) MULTI ACTUATOR

(75) Inventor: Seuk Hwan Chung, Hyungki-Do (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/881,263

(22) Filed: Jun. 14, 2001

(65) Prior Publication Data

US 2002/0076068 A1 Jun. 20, 2002

(30) Foreign Application Priority Data

Dec. 19, 2000 (KR) ..... 2000-78145
Mar. 16, 2001 (KR) ..... 2001-13778

(51) Int. Cl.[7] ..... H04R 25/00
(52) U.S. Cl. ..... 381/420; 381/396
(58) Field of Search ..... 381/396, 150, 381/151, 401, 412, 420, FOR 152, FOR 159, FOR 161; 340/388.1

(56) References Cited

U.S. PATENT DOCUMENTS 6,208,237 B1 * 3/2001 Saiki et al.

* cited by examiner

*Primary Examiner*—Sinh Tran
(74) *Attorney, Agent, or Firm*—Darby & Darby

(57) ABSTRACT

Disclosed is a multi actuator including a case having a space and a groove therein, a vibration plate for generating sound, of which outer end portion is fixed to an upper end portion of the case, a voice coil fixed to a lower end portion of the vibration plate, a magnet magnetized vertically, an upper plate attached to the magnet, for generating a magnetic field, a yoke for generating the magnetic field together with the magnet, upper and lower plate springs for supporting the yoke and vibration mass including a weight, and a vibration coil installed in an upper surface of a shield plate, for generating vibration using a magnetic flux formed in the magnetic field. The multi actuator used for mobile communication systems such as cellular phones and pagers provides a structure that prevents the plate springs from being deformed to improve reliability and vibration characteristic.

14 Claims, 5 Drawing Sheets

MULTI ACTUATOR

BACKGROUND OF THE INVENTION

1. Field of the Invention

The present invention relates to a multi actuator, in particular, a multi actuator to endure unexpected impact.

2. Description of the Related Art

Generally, a multi actuator serves to output electrically or electronically received audio signal or a preset bell or melody as an audible sound. Alternatively, the multi actuator serves to output a vibration signal as a termination signal. Such a multi actuator has been used for mobile communication systems such as cellular phones and pagers. However, since the multi actuator is required to always carry with its user and is mainly used in a place crowded with people, its inner structure may be deformed due to external impact or failing to hold it regardless of the user's intention.

Accordingly, demand for a multi actuator that can endure unexpected impact is on an increasing trend.

A multi actuator recently used for mobile communication means such as cellular phones includes a case having a space therein, a vibration plate for generating sound, of which outer end portion is fixed to an upper end portion of the case, a voice coil fixed to a lower end portion of the vibration plate, a magnet magnetized vertically, an upper plate attached to the magnet, for generating a magnetic field, a yoke for generating the magnetic field together with the magnet, upper and lower plate springs used as suspension springs to support the yoke and vibration mass including weight, and a vibration coil installed in an upper surface of a shield plate, for generating vibration using a magnetic flux formed in the magnetic field. If mutual locations of the above elements and their assembled state are deformed due to external impact, the multi actuator does not fail to perform its function.

In this respect, elements used for mobile communication systems such as cellular phones and pagers are subject to a drop test in various angles and directions at a certain height. Such a drop test is carried out for the multi actuator.

For the drop test, a jig is used to apply impact to the multi actuator at a certain height. The jig is repeatedly dropped several times in all sides. At this time, an opposing drop surface is formed of a steel plate that is a rigid material enough to apply impact to the product.

It is noted from the above drop test that deformation of the prior art multi actuator occurs between a case and a plate spring during lateral drop.

FIG. 2 shows a general type of a plate spring. The plate spring is fixed to a groove formed inside a case and supports a weight. The plate spring serves to determine mass of the weight and the natural frequency of the vibration of the magnetic field. Also, the plate spring acts on sound and vibration generated depending on input exciting frequency. In other words, it is necessary to maintain a constant value k of the spring and the mass m that significantly serves to determine the natural frequency of the vibration of the magnetic field, without any change.

SUMMARY OF THE INVENTION

It is, therefore, an object of the present invention to provide a multi actuator that fixes the location of vibration mass therein and prevents characteristic of a plate spring having an elastic coefficient from being varied when the mass vibrates, the elastic coefficient and the mass determining the natural frequency of the vibration of a magnetic field.

Another object of the present invention is to provide a multi actuator for use in a mobile communication system, which prevents a plate spring from being deformed to improve reliability and vibration characteristic.

To achieve the above object, there is provided a multi actuator including a case having a space and a groove therein, a vibration plate for generating sound, of which outer end portion is fixed to an upper end portion of the case, a voice coil fixed to a lower end portion of the vibration plate, a magnet magnetized vertically, an upper plate attached to the magnet, for generating a magnetic field, a yoke for generating the magnetic field together with the magnet, upper and lower plate springs for supporting the yoke and vibration mass including a weight, and a vibration coil installed in an upper surface of a shield plate, for generating vibration using a magnetic flux formed in the magnetic field.

BRIEF DESCRIPTION OF THE DRAWINGS

The above objects, features and advantages of the present invention will become more apparent from the following detailed description when taken in conjunction with the accompanying drawings, in which.

DETAILED DESCRIPTION OF THE PREFERRED EMBODIMENT

A preferred embodiment of the present invention will now be described with reference to the accompanying drawings. The matters defined in the description such as a detailed construction and elements of a circuit are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

A multi actuator according to the first embodiment of the present invention includes a case having a space and a groove therein, a vibration plate for generating sound, of which outer end portion is fixed to an upper end portion of the case, a voice coil fixed to a lower end portion of the vibration plate, a magnet magnetized vertically, an upper plate attached to the magnet, for generating a magnetic field, a yoke for generating the magnetic field together with the magnet, a weight constituting vibration mass together with the yoke, having a projection, upper and lower plate springs fixed to the groove of the case, and a vibration coil installed in an upper surface of a shield plate, for generating vibration using a magnetic flux formed in the magnetic field.

Figure 5:
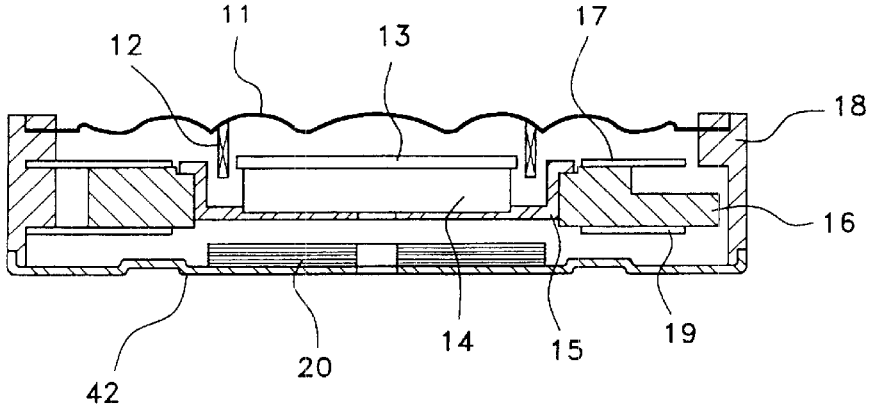
FIG. 5 is a sectional view along contour A-A' in FIG. 3 illustrating a multi actuator according to the first embodiment of the present invention.

The aforementioned multi actuator according to the first embodiment of the present invention will now be described in more detail with reference to FIG. 5.

If an alternating current of high frequency is applied to a voice coil 12 inside a magnetic field consisting of an upper plate 13, a magnet 14 magnetized vertically and a yoke 15 through an external lead line (not shown), electromagnetic force is generated. The voice coil 12 moves vertically by means of the generated electromagnetic force. At this time, a vibration plate 11 to which one end of the voice coil 12 is attached vibrates finely to generate sound.

Furthermore, if the alternating current is applied to a vibration coil 20 located in an upper surface of the shield plate 42, attraction and repulsion are generated by a magnetic flux leaked from the magnetic field consisting of the magnet 14 and the yoke 15. Thus, vibration mass including a weight 16 vibrates. Such vibration is transferred to the case 18 through plate springs 17 and 19 respectively connected with lower and upper portions of the weight 16.

In the aforementioned multi actuator according to the first embodiment of the present invention, in order for vibration characteristic affected by the mass and spring constant to be maintained unchanged by unexpected external impact or pressure, a projection is provided on an outer peripheral surface of the weight 16. Thus, a predetermined gap is maintained in circumferential and radius directions so as to endure impact during drop.

Figure 1:
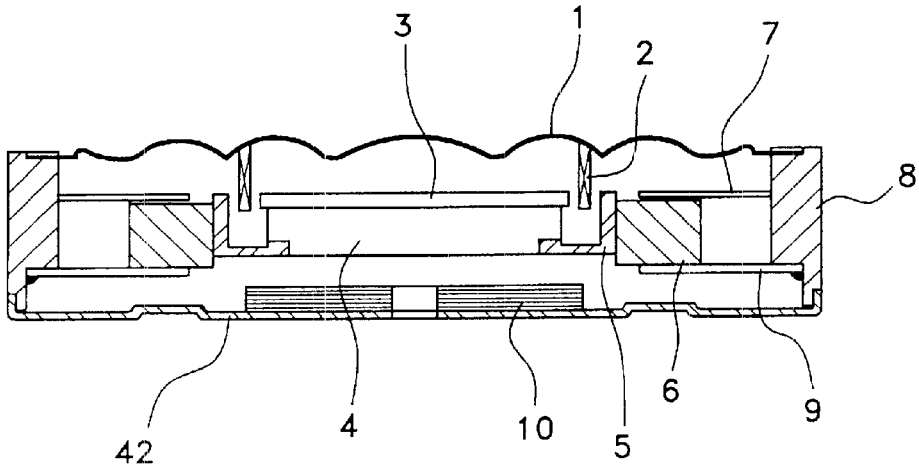
FIG. 1 is a sectional view illustrating an example of a prior art multi actuator.
Figure 2:
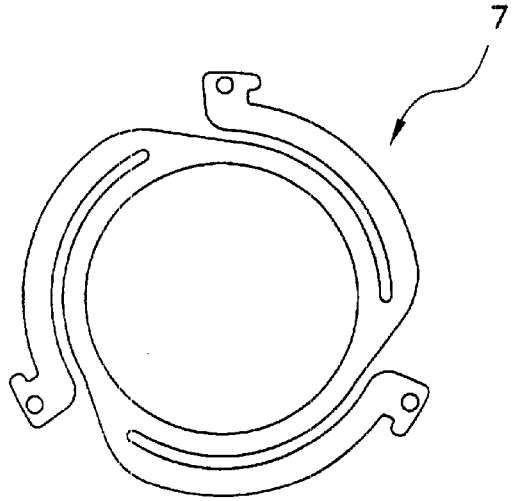
FIG. 2 PRIOR ART
FIG. 2 shows a prior art plate spring.
Figure 3:
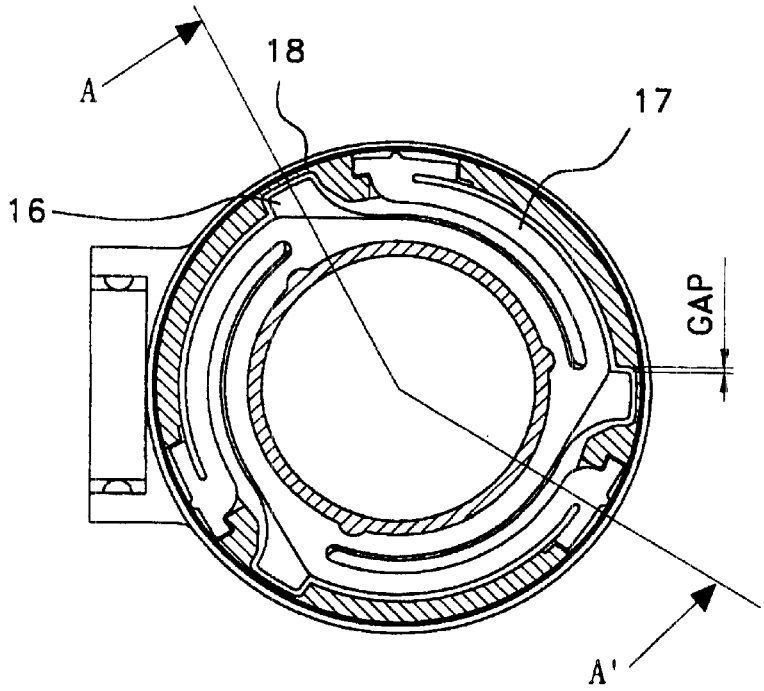
FIG. 3 shows displacement of an actuator depending on drop direction according to the present invention.

FIG. 3 shows displacement of an actuator depending on drop direction according to the present invention.

Figure 4:
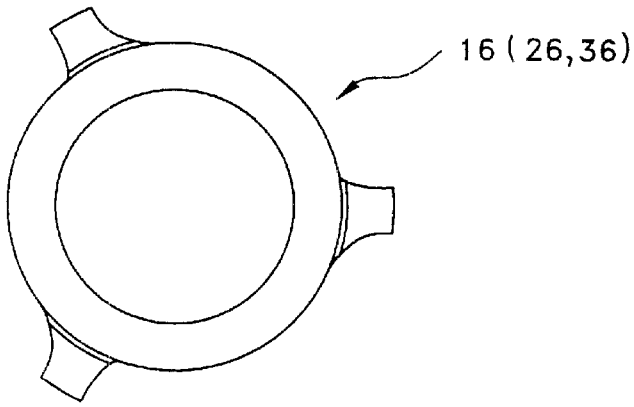
FIG. 4 shows a weight according to the present invention.

FIG. 4 is a plane view illustrating the weight according to the present invention, provided with a projection on an outer peripheral surface.

To increase vibration mass, a tungsten sintering product having high specific gravity is used as the weight.

Figure 6:
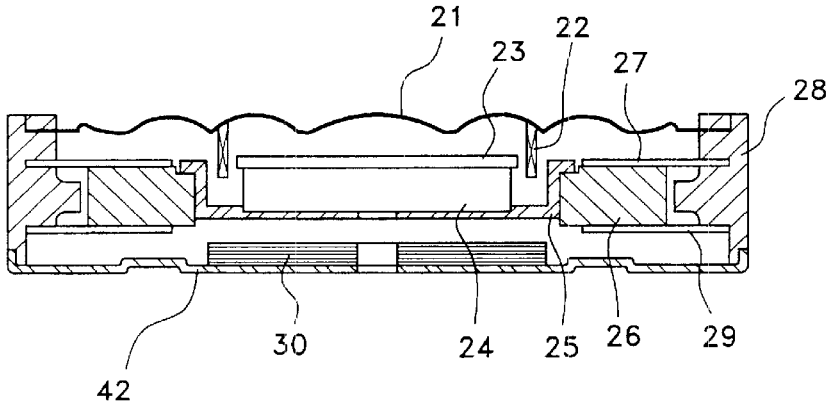
FIG. 6 is a sectional view illustrating a multi actuator according to the second embodiment of the present invention.

In the second embodiment of the present invention, a projection is additionally provided on an inner peripheral surface of the case, as shown in FIG. 6.

A multi actuator according to the second embodiment of the present invention includes a case having a space and a groove therein, provided with a projection between an upper plate spring and a lower plate spring on an inner peripheral surface, a vibration plate for generating sound, of which outer end portion is fixed to an upper end portion of the case, a voice coil fixed to a lower end portion of the vibration plate, a magnet magnetized vertically, an upper plate attached to the magnet, for generating a magnetic field, a yoke for generating the magnetic field together with the magnet, a weight constituting vibration mass together with the yoke, upper and lower plate springs fixed to the groove of the case, and a vibration coil installed in an upper surface of a shield plate, for generating vibration using a magnetic flux formed in the magnetic field.

The aforementioned multi actuator according to the second embodiment of the present invention will now be described in more detail with reference to FIG. 6.

If an alternating current of high frequency is applied to a voice coil 22 inside a magnetic field consisting of an upper plate 23, a magnet 24 magnetized vertically and a yoke 25 through an external lead line (not shown), electromagnetic force is generated. The voice coil 22 moves vertically by means of the generated electromagnetic force. At this time, a vibration plate 21 to which one end of the voice coil 22 is attached vibrates finely to generate sound.

Furthermore, if an alternating current of low frequency is applied to a vibration coil 30 located in an upper surface of the shield plate, attraction and repulsion are generated by a magnetic flux leaked from the magnetic field consisting of the magnet 24 and the yoke 25. Thus, vibration mass including a weight 26 vibrates. Such vibration is transferred to the case 28 through plate springs 27 and 29 respectively connected with lower and upper portions of the weight 26.

In the aforementioned multi actuator according to the second embodiment of the present invention, in order for vibration characteristic affected by the mass and spring constant to be maintained unchanged by unexpected external impact or pressure, a projection is provided on an inner peripheral surface of the case 28 which is to be coupled with the plate springs 27 and 29. Thus, a predetermined gap is maintained in circumferential and radius directions so as to endure impact during drop.

A multi actuator according to the third embodiment of the present invention will be described with reference to FIG. 7.

Figure 7:
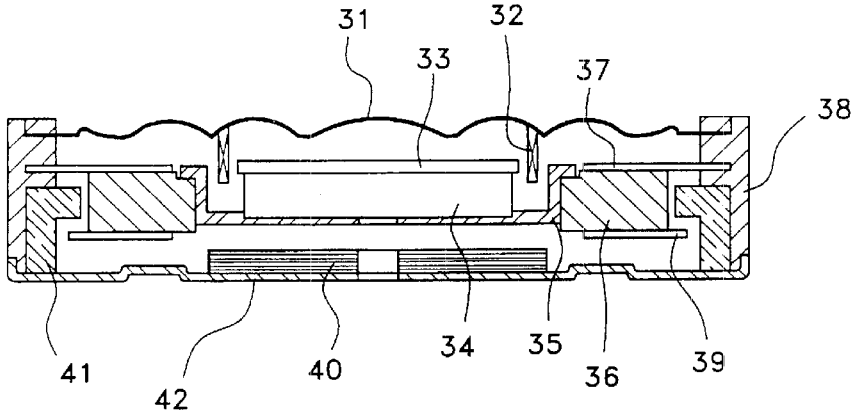
FIG. 7 is a sectional view illustrating a multi actuator according to the third embodiment of the present invention.
Figure 8:
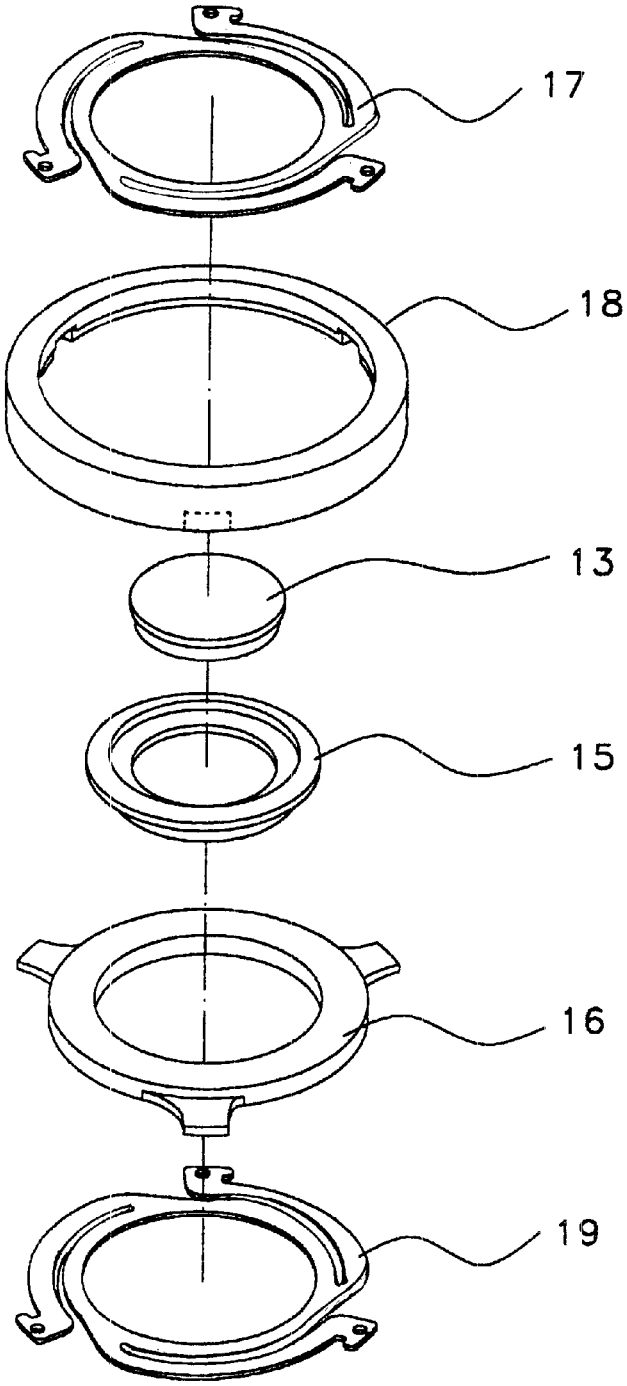
FIG. 8 is an exposed view showing portions of the actuator of FIGS. 3 and 5.
Figure 9:
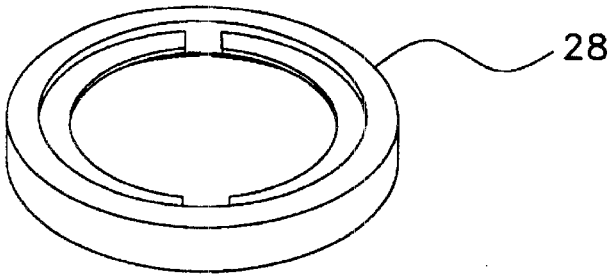
FIG. 9 is a perspective view of case 28 shown in FIG. 6
Figure 10:
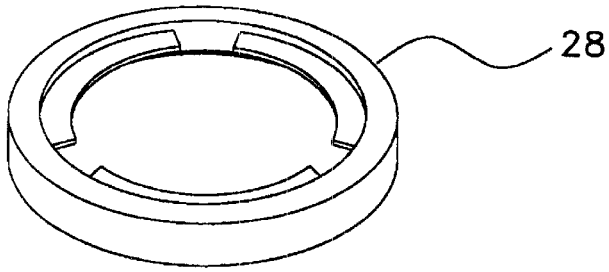
FIG. 10 is a perspective view of case 28 of FIG. 6 showing the case with three extensions.
Figure 11:
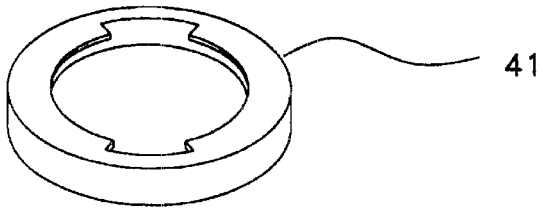
FIG. 11 a perspective view of ring-shaped member 41 of FIG. 7.
Figure 12:
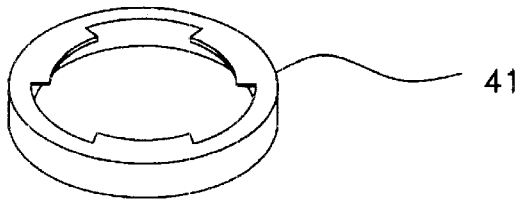
FIG. 12 is a perspective view of ring-shaped member 41 with three extensions.

As shown in FIG. 7, the multi actuator according to the third embodiment of the present invention includes a case 38 having a space and a groove therein, a ring-shaped member 41 inserted into a lower portion of the case 38, having at least two projections on an inner peripheral surface, a vibration plate 31 for generating sound, of which outer end portion is fixed to an upper end portion of the case 38, a voice coil 32 fixed to a lower end portion of the vibration plate 31, a magnet 34 magnetized vertically, an upper plate 33 attached to the magnet 34, for generating a magnetic field, a yoke 35 for generating the magnetic field together with the magnet 34, a weight 36 constituting vibration mass together with the yoke 35, upper and lower plate springs 37 and 39 respectively fixed to the groove of the case 38 and the ring-shaped member 41, and a vibration coil 40 installed in an upper surface of a shield plate 38, for generating vibration using a magnetic flux formed in the magnetic field.

In the multi actuator according to the third embodiment of the present invention, the ring-shaped member 41 is further provided to maintain certain intervals. The ring-shaped member 41 has a ring shape with an inner diameter smaller than that of the case 38 and is separately inserted into the case 38.

If an alternating current of high frequency is applied to a voice coil 32 inside a magnetic field consisting of an upper plate 33, a magnet 34 magnetized up and down and a yoke 35 through an external lead line (not shown), an electromagnetic force is generated. The voice coil 32 moves up and down by means of the generated electromagnetic force. At this time, a vibration plate 31 to which one end of the voice coil 32 is attached vibrates finely to generate sound.

Furthermore, if an alternating current of low frequency is applied to a vibration coil 40 located on an upper surface of the shield plate 42, attraction and repulsion are generated by a magnetic flux leaking from the magnetic field consisting of the magnet 34 and the yoke 35.

Thus, vibration mass including a weight 36 vibrates. Such vibration is transferred to the case 38 and the ring shaped member 41 through plate springs 37 and 39 respectively connected with upper and lower portions of the weight 36.

In the aforementioned multi actuator according to the third embodiment of the present invention, in order for vibration characteristic affected by the mass and spring constant to be maintained unchanged by unexpected external impact or pressure, projections are provided on an inner circumference of the ring shaped member 41 which is to be coupled with the ring shaped member 41 which is to be coupled with the plate spring 39. Thus, a predetermined gap is maintained in circumferential and radius directions so as to endure impact during drop.

As aforementioned, the multi actuator according to the present invention has the following advantages.

Since the multi actuator has a structure that prevents constants of the plate springs from being varied due to unexpected external impact or pressure and maintains vibration characteristic, it is possible to improve reliability of the actuator used for mobile communication systems.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A multi actuator comprising:

a case having an inner wall and containing a space;

a vibration plate for generating sound, an outer end portion thereof is fixed to an upper portion of the case;

a voice coil fixed to a lower portion of the vibration plate;

a magnet magnetized vertically;

an upper plate attached to the magnet, for generating a magnetic field;

a yoke for generating the magnetic field together with the magnet;

a weight within the space constituting vibration mass together with the yoke, having a periphery and at least two projections extending from the periphery towards the inner wall of the case, to limit the movement of the weight towards and away from the inner wall;

upper and lower plate springs fixed to the case; and a vibration coil installed in an upper surf ace of a shield plate, for generating vibration using a magnetic flux formed in the magnetic field.

2. The multi actuator of claim 1, wherein the weight is made of a tungsten sintering material.

3. The multi actuator of claim 1, wherein the projections of the weight are formed at equivalent intervals.

4. The multi actuator of claim 1, wherein the weight has three projections.

5. A multi actuator comprising:

a case having en inner wall and containing a space and at least two inward projections on the inner wall;

a vibration plate for generating sound, an outer end portion thereof is fixed to an upper portion of the case;

a voice coil fixed to a lower portion of the vibration plate;

a magnet magnetized vertically;

an upper plate attached to the magnet, for generating a magnetic field;

a yoke for generating the magnetic field together with the magnet;

a weight within the space constituting vibration mass together with the yoke, the weight being limited in movement towards and away from the inner wall by coming into contact with the projections;

upper and lower plate springs fixed to the case; and a vibration coil installed in an upper surface of a shield plate, for generating vibration using a magnetic flux formed in the magnetic field.

6. The multi actuator of claim 5, wherein the weight is made of a tungsten sintering material.

7. The multi actuator of claim 5, wherein the projections of the case are formed at equivalent intervals.

8. The multi actuator of claim 5, wherein the projections of the case are located between the upper and lower plate springs.

9. The multi actuator of claim 5, wherein the case has three projections.

10. A multi actuator comprising:

a case having a space and a groove therein;

a ring-shaped member inserted into a lower portion of the case, having at least two projections on an inner peripheral surface;

a vibration plate for generating sound, an outer end portion thereof is fixed to an upper end portion of the case;

a voice coil fixed to a lower end portion of the vibration plate;

a magnet magnetized vertically;

an upper plate attached to the magnet, for generating a magnetic field;

a yoke for generating the magnetic field together with the magnet;

a weight constituting vibration mass together with the yoke;

upper and lower plate springs respectively fixed to the groove of the case and the ring-shaped member; and a vibration coil installed in an upper surface of a shield plate, for generating vibration using a magnetic flux formed in the magnetic field.

11. The multi actuator of claim 10, wherein the weight is made of a tungsten sintering material.

12. The multi actuator of claim 10, wherein the projections of the ring-shaped member are formed at equivalent intervals.

13. The multi actuator of claim 10, wherein the projections of the ring-shaped member are located between the upper and lower plate springs.

14. The multi actuator of claim 10, wherein the ring-shaped member has three projections.

* * * * *